US008090112B2

(12) United States Patent
Shuttleworth

(10) Patent No.: US 8,090,112 B2
(45) Date of Patent: Jan. 3, 2012

(54) SELF-DIAGNOSTIC SYSTEM FOR MONITORING ELECTRICAL EQUIPMENT

(75) Inventor: Timothy Shuttleworth, Woodland Hills, CA (US)

(73) Assignee: Harman International Industries, Incorporated, Northridge, CA (US)

( * ) Notice: Subject to any disclaimer, the term of this patent is extended or adjusted under 35 U.S.C. 154(b) by 1160 days.

(21) Appl. No.: 09/949,107

(22) Filed: Sep. 7, 2001

(65) Prior Publication Data

US 2002/0071568 A1 Jun. 13, 2002

Related U.S. Application Data

(60) Provisional application No. 60/231,422, filed on Sep. 8, 2000.

(51) Int. Cl.
*H04R 29/00* (2006.01)

(52) U.S. Cl. ..... 381/58; 367/13; 73/645; 714/25

(58) Field of Classification Search ..... 381/58, 381/59, 60; 367/13; 73/645, 646, 647, 648; 714/25

See application file for complete search history.

(56) References Cited

U.S. PATENT DOCUMENTS

| | | | | |
|---|---|---|---|---|
| 5,450,624 | A * | 9/1995 | Porambo et al. | 455/226.4 |
| 5,652,542 | A * | 7/1997 | Fink | 330/2 |
| 5,719,526 | A * | 2/1998 | Fink | 330/2 |
| 6,058,195 | A * | 5/2000 | Klippel | 381/96 |
| 6,104,304 | A * | 8/2000 | Clark et al. | 340/664 |
| 6,385,739 | B1 * | 5/2002 | Barton et al. | 714/25 |

* cited by examiner

*Primary Examiner* — Xu Mei
*Assistant Examiner* — Con P Tran

(57) ABSTRACT

This invention relates to a self-diagnostic audio system including a digital signal processor (DSP) that monitors a plurality of electronic components in an audio system, such as an amplifier, speaker, memory, power supply, and DSP itself. The DSP may monitor various information from each of the electrical components, such as whether a particular electrical component is on or off, whether a particular component is functional, and whether the voltage current is between the components. The DSP may be linked to a reporting device so that if there is a problem, the DSP may report back and identify the existence and nature of a particular problem.

40 Claims, 2 Drawing Sheets

SELF-DIAGNOSTIC SYSTEM FOR MONITORING ELECTRICAL EQUIPMENT

CROSS-REFERENCE TO RELATED APPLICATION

This application is a non-provisional application claiming priority of U.S. provisional application Ser. No. 60,231,422 filed Sep. 8, 2000.

BACKGROUND OF THE INVENTION

1. Field of the Invention

This invention relates to a self-diagnostic audio system including a processor, such as a digital signal processor (DSP), to monitor a number of electronic components in an audio system.

2. Related Art

Speakers may be installed in remote areas that are difficult to get to and install a speaker. And even after installation, if a problem arises, fixing the speaker may be difficult as well. This is especially true for loudspeakers that are installed high above the floor to distribute the sound energy. If an actual problem with a speaker or an associated audio component exists, in many instances, technicians maintaining the equipment may not be well trained to diagnose the problem. Therefore, a technician may have a difficult task of getting to the speaker to diagnose the problem.

A speaker may not produce sound for a variety of reasons. For example, there may be an open circuit, a short within the speaker, or the amplifier may be damaged, just to name a few. With all of the problems the speaker could have, a technician may be slow to troubleshoot the problem. This can add to the repair cost. In some instances, a speaker that is producing poor quality sound may be difficult to detect because other speakers may drown out the problem speaker.

Therefore, there is a need for an audio system that can monitor itself to ensure that its electrical components are working properly; and, in particular, to be able to report back that there may be a problem with a particular electrical component and what that problem may be. This way, a technician can determine the particular audio component that may be malfunctioning.

SUMMARY

This invention provides a method and system for diagnosing the condition of an audio system periodically or continuously to ensure that the audio system is functioning properly. The audio system includes a processor, such as a DSP, that monitors a plurality of electronic components in an audio or visual system. For example, the DSP may monitor a power supply, an amplifier, speaker(s), a memory, the DSP itself, and thermal temperature models. The DSP may monitor from each of the electrical components various information, such as whether a particular electrical component is on or off, whether a particular component is functional, and whether the voltage current is between the components. The DSP may have an internal memory that is stored with instructions for the DSP. That is, as the DSP is monitoring the plurality of electrical components, the DSP uses the monitored information to perform calculations in accordance with the stored instruction(s) in the memory, and use the memory to store the results.

The internal memory of the DSP may be stored with predetermined parameter(s) for each of the electrical components. For example, the DSP may monitor the current and voltage in between the amplifier and speaker, and compare the two values with a predetermined current level and a predetermined voltage level value that is stored in the memory. The two predetermined values stored in the memory may represent the ideal current and voltage the DSP should detect if everything is working properly between the speaker and amplifier. On the other hand, if the monitored values are outside of the predetermined values, then the DSP may recognize that there may be a problem. If so, the DSP communicates with a reporting device to alert the operator of the audio system that there may be a problem.

For example, the DSP may detect that there is no current between an amplifier and a speaker. The DSP may also check for a voltage between the amplifier and the speaker. If the DSP detects voltage to the speaker, but no current, then the DSP may send a message that the circuit for the speaker may be open. After the DSP has made a calculation for a particular electrical component, the DSP may compare the results of that calculation with a design parameter to determine whether the calculation result is within or outside of the design parameter. If the result is outside a particular design parameter, the microprocessor may communicate to a reporting device the condition for each of the electronic devices. For example, the DSP may detect that there is voltage but no current between a speaker and an amplifier, the microprocessor may communicate to the reporting device that the speaker is disconnected to the amplifier or is broken because the parameter stored indicates that there should be a predetermined amount of current flowing through the speaker. The reporting device then initiates some type of output such as a flashing red light to indicate a potential problem.

One of the advantages of using a DSP to monitor the components in the audio system is that only one communication medium may be needed between the detection system and the reporting device to monitor the plurality of components in the audio system. That is, a separate communication medium may not be required to each of the components with the invention. Alternatively, the DSP may monitor the temperature of the transducer to ensure that the transducer does not overheat. For example, if the transducer overheats because it is being driven too hard and for too long, then the DSP invention may reduce the power supplied to the transducer to prevent it from burning up.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
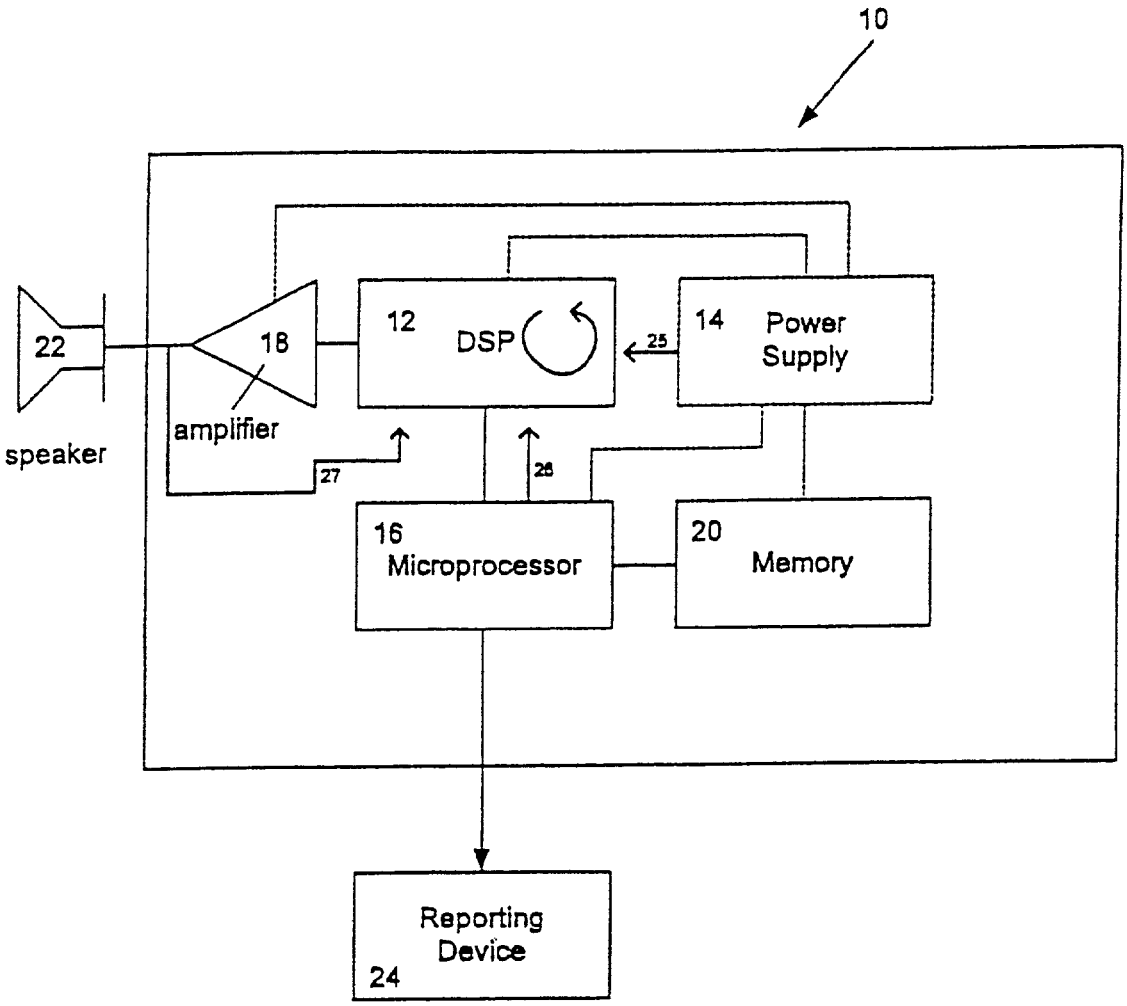
FIG. 1 is a block diagram including a DSP designed to monitor an amplifier, a speaker, a power supply, and report the monitoring information to a microprocessor which then sends an output signal based upon the monitored information to a reporting device.

FIG. 1 illustrates a self-diagnostic audio system (SDAS) 10 including a digital signal processor 12 capable of monitoring a plurality of electronic components. The DSP 12 may monitor a power amplifier 18, at least one speaker 22, and a power supply 14. The DSP 12 may monitor the functional status of the various electronic components and may access a memory device 20 so that it may compare monitored parameters from the various electronic components to predetermined settings stored in the memory 20. The results may then be forwarded to a microprocessor 16 that processes an output based upon the comparison or functional status, to a reporting device 24. Alternatively, the DSP may be a microprocessor that forwards an output command directly to the reporting device. The power supply 14 may also act to supply power to the amplifier 18, the microprocessor 16, the DSP 12, and the memory 20.

Figure 2:
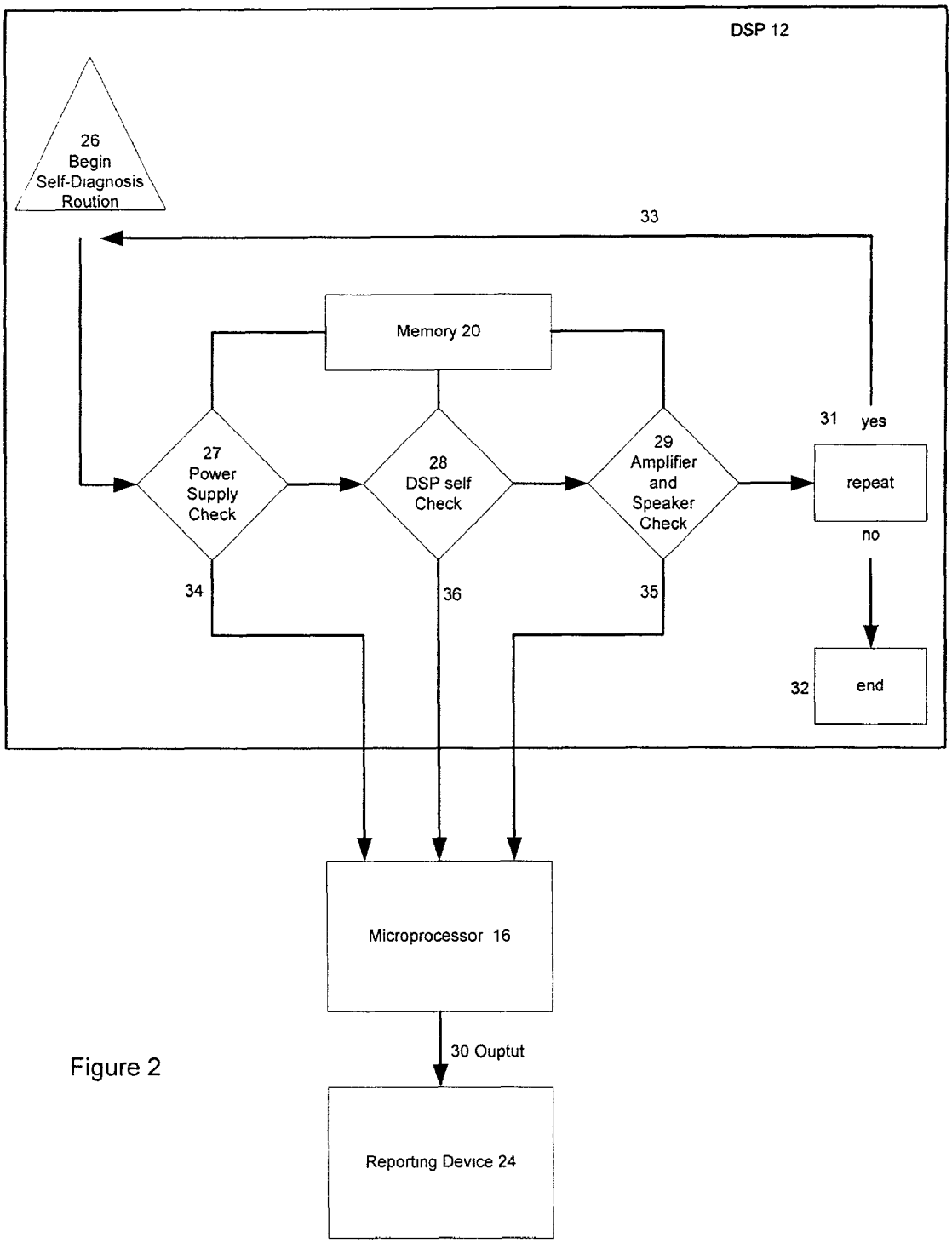
FIG. 2 is a flow chart for a self-diagnosis routine for a combination power supply, a DSP, and an amplifier and a speaker.

FIG. 2 illustrates a flow chart that represents a functional algorithm for the self diagnostic routine. The DSP may contain in firmware the algorithm for the self diagnosis routine. In step 27, the DSP 12 monitors the power supply 14. The DSP may first check the overall power output level generated by the power supply and then generate comparison information based upon the monitored information and some predetermined setting stored in the memory 20. The DSP may also monitor the power output levels generated by the power supply for each individual electronic component and then generate comparison information based upon the monitored information and some predetermined settings stored in the memory 20. The comparison information is forwarded to a microprocessor 16 that generates an output signal 30 based upon the comparison information.

For example, the DSP may monitor the overall power output level to be 50 watts, and compare this value to a predetermined ideal power output of 40 watts. Accordingly, the power output may be 10 watts too high. To indicate such, the output signal 30 may be a "red light" signal sent to the reporting device 24 to generate a red dot, for example. On the other hand, if the power output is substantially similar to the predetermined setting, the output signal 30 may be a "green light" signal so that the reporting device 24 generates a green dot, for example. The reporting device 24 may also contain a display output device such as an LCD so that it may generate a textual signal in response to the output 30 in order to instruct the operator to perform an action, such as "turn off" or "turn on" the power supply. The reporting device 24 may also contain a speaker output so that it may generate audible signals in response to the output 30 in order to instruct the operator to perform an action. The power supply check stage 27 of the algorithm may also check the levels of the individual power outputs from the power supply to the various components of the system.

The DSP may also check itself 28 and generate functional status information based upon the monitored information. The DSP may also monitor various internal parameters and then generate comparison information based upon the monitored information and some predetermined settings stored in the memory 20. The memory may be located inside the DSP or inside the microprocessor, which may be a separate unit as indicated in FIG. 1.

The functional status information may be the functional state of various components of the DSP. The functional information may be forwarded to the microprocessor 16 that generates an output signal 30 based upon the functional information. For example, the DSP may monitor whether its acoustic processing is being performed or not. The functional status information may be an "everything functioning okay" associated with the acoustic processing, and the output signal 30 may be a "green light" signal which the reporting device 24 would use to generate a green dot, for example, indicating that the acoustic processing is functional. The DSP may also compare monitored information, such as the rate of processing, with some predetermined setting, generate comparison information, forward this information to the microprocessor, which then generates an output signal to the reporting device 24 to generate a message.

The DSP may then check the amplifier and speaker and generate functional status information based upon the monitored information 29. The DSP may also monitor the amplification level generated by the power amplifier and then generate comparison information based upon the monitored information and some predetermined settings stored in the memory 20. The functional status information may be the current and voltage levels at the wire connecting the speaker to the amplifier. The DSP is thus able to determine whether the speaker is functional and if the amplifier is functional. The functional information is forwarded to the microprocessor 16 to generate an output signal 30 based upon the functional information.

For example, the DSP may monitor the current and voltage at the wire and determine that the speaker is not functioning (no current) but the amplifier is functioning (voltage exists). Accordingly, the functional information may be an "on" associated with the amplifier and an "off" associated with the speaker. Both types of information may be sent to the reporting device 24 to generate a red dot for the speaker and a green dot for the amplifier.

This process can be repeated 31 at an arbitrary rate for an arbitrary number of different electronic components. For example, the self diagnosis routine may proceed 20 times per second, and monitor any number of amplifiers and speakers. Alternatively, the DSP itself can generate an output signal based upon the comparison information, as opposed to the microprocessor. Furthermore, there can be a myriad of monitoring parameters on the electronic components, including, but not limited to monitoring voltage levels, current levels, power levels, functional states, processing rates, acoustic levels, sound pressure levels, frequency responses, frequency center, frequency bandwidth, bass response, temperature, monitoring via thermal models, etc.

While various embodiments of the application have been described, it will be apparent to those of ordinary skill in the art that many more embodiments and implementations are possible within the scope of this invention. Accordingly, the invention is not to be restricted except in light of the attached claims and their equivalents.

What is claimed is:

1. A self-diagnostic audio system, comprising:

a power amplifier;

a loudspeaker;

a memory; and a processor;

where the processor during operation is configured to periodically generate monitored information of the loudspeaker regardless of audio input signals to the audio system, where the monitored information of the loudspeaker is selected from the group consisting of: an acoustic level, a sound pressure level, a frequency response, a frequency center, a frequency bandwidth, a bass response, and a temperature; and where the processor is configured to generate a comparison result based on comparing the monitored information with a predetermined parameter stored in the memory.

2. The self-diagnostic audio system of claim 1 further including a reporting device, where the processor is configured to report the comparison result to the reporting device.

3. The self-diagnostic audio system of claim 1, where the processor includes a digital signal processor.

4. The self-diagnostic audio system of claim 1 where the loudspeaker includes a transducer and the processor is configured to generate monitored information of the loudspeaker including a temperature of the loudspeaker transducer.

5. The self-diagnostic audio system of claim 4 further including a memory, where the processor is configured to generate a comparison result based on comparing the monitored information with a predetermined parameter stored in the memory.

6. The self-diagnostic audio system of claim 5 where the power amplifier supplies power to the loudspeaker, and the processor is configured to reduce power supplied by the amplifier to the transducer when the monitored information is outside the predetermined parameter.

7. The self-diagnostic audio system of claim 5 further including a reporting device, where the processor is configured to report the comparison result to the reporting device.

8. The self-diagnostic audio system of claim 4, where the processor includes a digital signal processor.

9. The self-diagnostic audio system of claim 1, where the processor is configured to generate monitored information of the loudspeaker selected from the group consisting of: a voltage level, a current level, and a power level.

10. A method for self-diagnosing an audio system, comprising:

placing a loudspeaker in communication with a power amplifier configured to supply power to the loudspeaker, and placing a processor in communication with the loudspeaker;

placing a memory in communication with the processor;

causing the processor to periodically generate during normal operation of the audio system monitored information of the loudspeaker regardless of audio input signals to the audio system, where the monitored information of the loudspeaker is selected from the group consisting of: an acoustic level, a sound pressure level, a frequency response, a frequency center, a frequency bandwidth, a bass response, and a temperature; and causing the processor to generate a comparison result based on comparing the monitored information with a predetermined parameter stored in the memory.

11. The method of claim 10 further including placing a reporting device in communication with the processor, and causing the processor to report the comparison result to the reporting device.

12. The method of claim 10 where the loudspeaker includes a transducer, and including causing the processor to generate monitored information of the loudspeaker including a temperature of the loudspeaker transducer.

13. The method of claim 12 including causing the processor to reduce power supplied by the amplifier to the transducer when the monitored information is outside the predetermined parameter.

14. The method of claim 12 further including placing a reporting device in communication with the processor, and causing the processor to report the comparison result to the reporting device.

15. The method of claim 10, further including causing the processor to generate monitored information of the loudspeaker selected from the group consisting of: a voltage level, a current level, and a power level.

16. A method for self-diagnosing an audio system having a plurality of electronic components, comprising:

monitoring the plurality of electronic components with a digital signal processor (DSP) during normal operation regardless of audio input signals to the audio system to periodically generate monitored information for each of the plurality of the electrical components; comparing the monitored information with a predetermined parameter stored in a memory; generating a comparison result based upon the comparison between the monitored information and the predetermined parameter; and reporting the comparison result to a reporting device.

17. The method according to claim 16, wherein the comparing the monitored information with a predetermined parameter stored in a memory is done by the DSP.

18. The method according to claim 16, wherein the generating the comparison result based upon the comparison between the monitored information and the predetermined parameter is done by the DSP.

19. The method according to claim 16, wherein the comparing the monitored information with a predetermined parameter stored in a memory is done by a microprocessor.

20. The method according to claim 16, wherein the generating the comparison result based upon the comparison between the monitored information and the predetermined parameter is done by a microprocessor.

21. The method according to claim 16, further includes a microprocessor to interrogate the DSP and to report the monitoring information.

22. The method according to claim 16, wherein the memory is within the DSP.

23. The method according to claim 16, wherein the plurality of electrical components includes: a loudspeaker; an amplifier coupled to the loudspeaker; the amplifier coupled to the DSP; and a power supply providing power to the amplifier, the DSP, and the memory.

24. The method according to claim 23, further includes a microprocessor coupled to the DSP, the memory, and the reporting device, wherein the power supply provides voltage and current to the microprocessor.

25. The method according to claim 23, further including the steps of: monitoring the voltage and the current between the loudspeaker and the amplifier by the DSP to determine if the loudspeaker and the amplifier are functioning.

26. The method according to claim 25, wherein if the current is below a predetermined current parameter and the voltage is substantially within a predetermined voltage parameter, then the DSP communicates to the reporting device a fault signal for the loudspeaker.

27. The method according to claim 25, wherein if the voltage is below a predetermined voltage parameter and the current is substantially within a predetermined current parameter, then the DSP communicates to the reporting device a fault signal for the amplifier.

28. The method according to claim 16, wherein the DSP monitors itself.

29. The method according to claim 16, further including the step of: processing acoustic levels of the audio system by the DSP.

30. The method according to claim 16, wherein the step of monitoring further includes: reporting the functional status of each of the plurality of electronic components.

31. The method according to claim 16, wherein one of the plurality of electronic components is a transducer.

32. A self-diagnostic audio system having a plurality of electronic components, including: a digital signal processor (DSP) communicatively coupled to the plurality of electronic components; a memory device communicatively coupled to the DSP containing predetermined parameters; a microprocessor communicatively coupled to the DSP; and a reporting device communicatively coupled to the microprocessor, wherein the DSP periodically monitors each of the plurality of electronic components during normal operation to generate monitoring information regardless of audio input signals to the audio system and forwards the monitoring information to the microprocessor, which generates an output signal based upon a comparison of the monitoring information with at least one of the predetermined parameters, the microprocessor forwarding the output signal to the reporting device which generates an output based upon the output signal.

33. The system according to claim 32, wherein the plurality of electrical components includes: a speaker; an amplifier coupled to the speaker; the amplifier coupled to the DSP; a power supply providing voltage and current to the amplifier, the DSP, and the memory.

34. The system according to claim 33, wherein the DSP monitors the voltage and the current between the loudspeaker and the amplifier.

35. The system according to claim 34, wherein if the current is below a predetermined current parameter stored within the DSP and the voltage is substantially within a predetermined voltage parameter stored within the DSP, then the DSP communicates to the reporting device a fault signal for the loudspeaker.

36. The system according to claim 34, wherein if the voltage is below a predetermined voltage parameter stored within the DSP and the current is substantially within a predetermined current parameter stored within the DSP, then the DSP communicates to the reporting device a fault signal for the amplifier.

37. A monitoring device, comprising: means for monitoring periodically regardless of audio input a plurality of electronic components in an audio system during normal operation to generate monitored information of the audio system; means for detecting if any of the plurality of electronic components are malfunctioning by comparing the monitored information with predetermined parameters; and means for reporting the malfunctioning electronic component.

38. The monitoring device according to claim 37, wherein the audio system includes a loudspeaker and an amplifier, wherein the means for monitoring the plurality of electronic components is a digital signal processor (DSP) that stores the predetermined parameters and that monitors voltage and current between the loudspeaker and the amplifier.

39. The monitoring device according to claim 38, wherein if the current is below a predetermined current parameter of the predetermined parameters and the voltage is substantially within a predetermined voltage parameter of the predetermined parameters, then the DSP communicates to the reporting device a fault signal for the loudspeaker.

40. The monitoring device according to claim 38, wherein if the voltage is below a predetermined voltage parameter of the predetermined parameters and the current is substantially within a predetermined current parameter of the predetermined parameters, then the DSP communicates to the reporting device a fault signal for the amplifier.

* * * * *